US008047131B2

(12) United States Patent
Onishi et al.

(10) Patent No.: US 8,047,131 B2
(45) Date of Patent: Nov. 1, 2011

(54) PRESS MACHINE, CONTROL APPARATUS AND CONTROL METHOD OF PRESS MACHINE

(75) Inventors: Dan Onishi, Tokyo (JP); Kazumichi Okajima, Tokyo (JP)

(73) Assignee: IHI Corporation, Tokyo (JP)

( * ) Notice: Subject to any disclaimer, the term of this patent is extended or adjusted under 35 U.S.C. 154(b) by 457 days.

(21) Appl. No.: 12/294,695

(22) PCT Filed: Mar. 26, 2007

(86) PCT No.: PCT/JP2007/056171

§ 371 (c)(1),
(2), (4) Date: Sep. 26, 2008

(87) PCT Pub. No.: WO2007/116673

PCT Pub. Date: Oct. 18, 2007

(65) Prior Publication Data

US 2010/0170405 A1 Jul. 8, 2010

(30) Foreign Application Priority Data

Apr. 6, 2006 (JP) ..... 2006-105575

(51) Int. Cl.
*B30B 15/14* (2006.01)
*B30B 1/26* (2006.01)

(52) U.S. Cl. ..... 100/35; 100/46; 100/48; 72/10.2

(58) Field of Classification Search ..... 100/35, 100/43, 48, 282, 46; 72/10.2; 700/165, 206
See application file for complete search history.

(56) References Cited

U.S. PATENT DOCUMENTS 6,474,227 B2 * 11/2002 Narita ..... 100/35
6,647,870 B2 * 11/2003 Kohno ..... 100/269.14
2003/0116037 A1 * 6/2003 Tanaka et al. ..... 100/282

FOREIGN PATENT DOCUMENTS

CN 1438113 A 8/2003
JP 06-031499 2/1994
JP 6-31499 A 2/1994

(Continued)

OTHER PUBLICATIONS

Office Action issued in corresponding Russian Application No. 2008143987 dated Jun. 30, 2010.
International Search Report issued in corresponding application No. PCT/JP2007/056171, completed Jun. 5, 2007 and mailed Jun. 26, 2007.

(Continued)

*Primary Examiner* — Jimmy T Nguyen
(74) *Attorney, Agent, or Firm* — Griffin & Szipl, P.C.

(57) ABSTRACT

A control apparatus of a press machine in which a motor performance torque is fluctuated in accordance with a rotational angle of the rotating body in the case of rotating the motor at a fixed instruction speed. The control apparatus includes an angle detecting apparatus detecting a rotational angle of the rotating body, a torque determining apparatus determining a necessary motor torque in correspondence to a characteristic of the press machine on the basis of a value of the rotational angle input from the angle detecting apparatus, and a speed adjusting apparatus increasing the rotational instruction speed of the motor to a value more than the fixed instruction speed, at the rotational angle of the rotating body in which the necessary motor torque becomes smaller than a predetermined motor torque reference value.

14 Claims, 9 Drawing Sheets

FOREIGN PATENT DOCUMENTS

| | | | |
|---|---|---|---|
| JP | 6031499 | A | 2/1994 |
| JP | 08-103900 | | 4/1996 |
| JP | 2003-181698 | | 7/2003 |
| JP | 2003-181698 | A | 7/2003 |
| JP | 2003-205395 | | 7/2003 |
| JP | 2004-344946 | | 12/2004 |

OTHER PUBLICATIONS

Office Action issued Korean Patent Application No. 10-2008-7023748, issued Oct. 22, 2010.

Office Action issued in Chinese Patent Application No. 200780012212.x, dated Feb. 23, 2011.

* cited by examiner

PRESS MACHINE, CONTROL APPARATUS AND CONTROL METHOD OF PRESS MACHINE

This is a National Phase Application in the United States of International Patent Application No. PCT/JP2007/056171 filed Mar. 26, 2007, which claims priority on Japanese Patent Application No. 105575/2006, filed Apr. 6, 2006. The entire disclosures of the above patent applications are hereby incorporated by reference.

BACKGROUND OF THE INVENTION

1. Field of the Invention

The present invention relates to a press machine having a mechanism converting a rotational motion into a reciprocating motion.

2. Description of the Related Art

A press machine includes a hydraulic press driving a slide on the basis of a hydraulic pressure, and a mechanical press driving a slide on the basis of a mechanical mechanism.

The mechanical press includes a crank press rotationally driving a crank shaft by a motor. In the crank press, a slide is ascended and descended on the basis of a rotation of the crank shaft.

The press is executed by sandwiching a worked subject between an upper metal mold fixed to a lower surface of the slide and a lower metal mold arranged in a lower side of the slide, at a time when the slide descends.

Further, the mechanical press includes a mechanical press employing a flywheel in which a rotational energy is accumulated, and a mechanical press employing a servo motor which can freely adjust a forward rotation, a backward rotation and a speed change without using the flywheel.

The press machine employing the flywheel transmits a rotational driving force of a motor 41 to a flywheel 47 via a pulley 43 and a transmission belt 45, for example, as shown in FIG. 1. A clutch 49 couples the flywheel 47 to a main gear 51 in an ON state, and disconnects the flywheel 47 from the main gear 51 in an OFF state.

The main gear 51 is fixed to one end portion of a crank shaft 53, and the crank shaft 53 is rotationally driven together with the main gear 51.

One end portion of a coupling member 55 is coupled to an eccentric portion of the crank shaft 53, and a slide 57 is coupled to the other end portion of the coupling member 55. Accordingly, a rotational motion of the crank shaft 53 is converted into a reciprocating linear motion of the slide 57, and the slide 57 is ascended and descended.

In this structure, the rotational energy accumulated in the flywheel 47 is discharged in a rotational angle region of the crank shaft 53 pressing a worked subject, and is again accumulated in the flywheel 47 in the other rotational angle region.

In the case of the press machine employing the flywheel, an apparatus is enlarged in size at a degree of an employment of the flywheel and the clutch, however, in the case of the press machine employing the servo motor, there is an advantage that the flywheel and the clutch can be omitted.

However, in the case of the press machine employing the servo motor, since it is impossible to accumulate the rotational energy in the flywheel, it is necessary to set the servo motor and a power source equipment for driving the motor to a large capacity.

Taking this point into consideration, in Patent Document 1 (Japanese Laid-Open Patent Publication No. 2004-344946 "Press Machine"), a condenser for accumulating an electric energy is connected to an AC power supply equipment, and the electric energy accumulated in the condenser is supplied to the servo motor in the rotational angle region of the crank shaft pressing the worked subject.

Accordingly, the AC power supply equipment is downsized, and an energy necessary at a time of pressing is secured.

However, in the case of Patent Document 1, since a great current is supplied to the servo motor in the rotational angle region of the crank shaft pressing the worked subject even if the AC power supply equipment can be downsized, a drive circuit directly driving the servo motor is enlarged at that degree.

On the other hand, it is desired to further downsize the motor and the drive circuit of the motor in the press machine employing the flywheel.

Further, it is desired to lower an electric power consumption in the press machine.

SUMMARY OF THE INVENTION

Accordingly, an object of the present invention is to provide a press machine, a control apparatus and a control method of the press machine, which can downsize a motor and a drive circuit of the motor, and can lower an electric power consumption.

If a crank shaft is rotated at a fixed instruction speed by a motor, a performance torque of the motor is fluctuated in accordance with a rotational angle of the crank shaft, on the basis of various mechanical elements coupled to the crank shaft, even in a state in which a worked subject is not pressed actually.

The present invention is structured such as to efficiently apply a rotational energy to a rotational system by utilizing the fluctuation of the motor performance torque as mentioned above.

In other words, in accordance with the present invention, in order to achieve the object mentioned above, there is provided a control apparatus of a press machine comprising: a motor; a converting mechanism having a rotating body rotationally driven by the motor and converting a rotational motion into a reciprocating motion; and a slide coupled to the converting mechanism and reciprocating, a motor performance torque being fluctuated in accordance with a rotational angle of the rotating body in the case of rotating the motor at a fixed instruction speed, wherein the control apparatus comprises:

an angle detecting apparatus detecting a rotational angle of the rotating body;

a torque determining apparatus determining a necessary motor torque in correspondence to a characteristic of the press machine on the basis of a value of the rotational angle input from the angle detecting apparatus; and a speed adjusting apparatus increasing the rotational instruction speed of the motor to a value more than the fixed instruction speed, at the rotational angle of the rotating body in which the necessary motor torque becomes smaller than a predetermined motor torque reference value.

As mentioned above, in the control apparatus of the press machine in accordance with the present invention, since the necessary motor torque is determined in correspondence to the characteristic of the press machine, and the rotational speed of the motor is increased to a value more than the fixed instruction speed at the rotational angle of the rotating body in which the necessary motor torque becomes smaller than the previously determined motor torque reference value, it is possible to efficiently apply the rotational energy to the rotational system. Accordingly, it is possible to effectively lower the maximum motor torque value.

Accordingly, since it is possible to lower the maximum motor torque value, it is possible to make the electric capacities of the motor and the motor driving portion small, and it is possible to downsize the motor and the motor driving portion.

Further, since it is possible to efficiently apply the rotational energy to the rotating system, it is possible to lower an electric power consumption.

Further, in accordance with the present invention, in order to achieve the object mentioned above, there is provided a control apparatus of a press machine comprising: a motor; a converting mechanism having a rotating body rotationally driven by the motor and converting a rotational motion into a reciprocating motion; and a slide coupled to the converting mechanism and reciprocating, a motor performance torque being fluctuated in accordance with a rotational angle of the rotating body in the case of rotating the motor at a fixed instruction speed, wherein the control apparatus comprises:

an angle detecting apparatus detecting a rotational angle of the rotating body;

a torque determining apparatus determining a necessary motor torque in correspondence to a characteristic of the press machine on the basis of a value of the rotational angle input from the angle detecting apparatus; and a speed adjusting apparatus decreasing the rotational instruction speed of the motor to a value less than the fixed instruction speed, at the rotational angle of the rotating body in which the necessary motor torque becomes larger than a predetermined motor torque reference value.

As mentioned above, in the control apparatus of the press machine mentioned above, since the necessary motor torque is determined in correspondence to the characteristic of the press machine, and the rotational speed of the motor is decreased to a value less than the fixed instruction speed at the rotational angle of the rotating body in which the necessary motor torque becomes larger than the previously determined motor torque reference value, it is possible to inhibit the efficiency of applying the rotational energy to the rotational system from being deteriorated.

Accordingly, since it is possible to lower the electric power consumption, and suppress the maximum motor torque value, it is possible to make an electric capacities of the motor and the motor driving portion small.

Further, in accordance with the present invention, there is provided a control apparatus of a press machine comprising: a motor; a converting mechanism having a rotating body rotationally driven by the motor and converting a rotational motion into a reciprocating motion; and a slide coupled to the converting mechanism and reciprocating, a motor performance torque being fluctuated in accordance with a rotational angle of the rotating body in the case of rotating the motor at a fixed instruction speed, wherein the control apparatus comprises:

an angle detecting apparatus detecting a rotational angle of the rotating body;

a torque determining apparatus determining a necessary motor torque in correspondence to a characteristic of the press machine on the basis of a value of the rotational angle input from the angle detecting apparatus; and a speed adjusting apparatus increasing the rotational instruction speed of the motor to a value more than the fixed instruction speed, at the rotational angle of the rotating body in which the necessary motor torque becomes smaller than a predetermined motor torque reference value, and decreasing the rotational instruction speed of the motor to a value less than the fixed instruction speed, at the rotational angle of the rotating body in which the necessary motor torque becomes larger than the predetermined motor torque reference value.

As mentioned above, in the control apparatus of the press machine in accordance with the present invention, since the necessary motor torque is determined in correspondence to the characteristic of the press machine, and the rotational speed of the motor is increased to a value more than the fixed instruction speed at the rotational angle of the rotating body in which the necessary motor torque becomes smaller than the previously determined motor torque reference value, it is possible to efficiently apply the rotational energy to the rotational system. Accordingly, it is possible to effectively lower the maximum motor torque value.

Further, since the rotational speed of the motor is decreased to a value less than the fixed instruction speed at the rotational angle of the rotating body in which the necessary motor torque becomes larger than the previously determined motor torque reference value, it is possible to inhibit the efficiency of applying the rotational energy to the rotational system from being deteriorated.

Accordingly, since it is possible to lower the maximum motor torque value and it is possible to lower the electric power consumption, it is possible to make the electric capacities of the motor and the motor driving portion small.

Further, in accordance with a preferable aspect of the present invention, the speed adjusting apparatus increases or decreases the rotational instruction speed of the motor from the fixed instruction speed by a magnitude of a value that is obtained by multiplying a fixed gain by a difference between the necessary motor torque and the motor torque reference value.

As mentioned above, since the rotational instruction speed of the motor is increased or decreased by an amount which is in proportion to a torque fluctuation amount, it is possible to more effectively apply the rotational energy to the rotational system.

In accordance with a preferable aspect of the present invention, a time integral value over a predetermine time is equal between an amount by which the speed adjusting apparatus increases the rotational instruction speed of the motor, and an amount by which the speed adjusting apparatus decreases the rotational instruction speed of the motor.

As mentioned above, since the amount of increasing the rotational instruction speed and the amount of decreasing the rotational instruction speed are equal in the time integral value thereof over the predetermined time, it is possible to align a press operating time over a predetermined time with a pressing operating time over a predetermined time in the case of rotating the motor at the fixed instruction speed, thereby preventing a press production speed from being lowered.

In accordance with the present invention, it is possible to provide a press machine having the control apparatus mentioned above.

Further, in accordance with the present invention, there is provided a control method of a press machine comprising:

a motor; a converting mechanism having a rotating body rotationally driven by the motor and converting a rotational motion into a reciprocating motion; and a slide coupled to the converting mechanism and reciprocating, a motor performance torque being fluctuated in accordance with a rotational angle of the rotating body in the case of rotating the motor at a fixed instruction speed, wherein the control method comprises the steps of:

detecting a rotational angle of the rotating body;

determining a necessary motor torque in correspondence to a characteristic of the press machine on the basis of a value of the detected rotational angle; and increasing the rotational instruction speed of the motor to a value more than the fixed instruction speed, at the rotational angle of the rotating body in which the necessary motor torque becomes smaller than a predetermined motor torque reference value, wherein the necessary motor torque is determined on the basis of a motor torque fluctuation factor on the basis of the reciprocation of the slide, and a motor torque fluctuation factor on the basis of the rotational motion of the rotating body.

In the control method of the press machine in accordance with the present invention mentioned above, since the necessary motor torque is determined in correspondence to the characteristic of the press machine, and the rotational speed of the motor is increased to a value more than the fixed instruction speed at the rotational angle of the rotating body in which the necessary motor torque becomes smaller than the predetermined motor torque reference value, it is possible to efficiently apply the rotational energy to the rotational system. Accordingly, it is possible to effectively reduce the maximum motor torque value.

Accordingly, since it is possible to reduce the maximum motor torque value, it is possible to make the electric capacities of the motor and the motor driving portion small, and it is possible to downsize the motor and the motor driving portion.

Further, since it is possible to efficiently apply the rotational energy to the rotational system, it is possible to lower the electric power consumption.

Further, by determining the necessary motor torque on the basis of the motor torque fluctuation factor on the basis of the reciprocating motion of the slide, and the motor torque fluctuation factor on the basis of the rotational motion of the rotating body, it is possible to execute the control of the motor rotational speed taking into consideration the motor torque fluctuation factor on the basis of the reciprocating motion of the slide and the rotational motion of the rotating body.

Further, in accordance with the present invention, there is provided a control method of a press machine comprising:

a motor; a converting mechanism having a rotating body rotationally driven by the motor and converting a rotational motion into a reciprocating motion; and a slide coupled to the converting mechanism and reciprocating, a motor performance torque being fluctuated in accordance with a rotational angle of the rotating body in the case of rotating the motor at a fixed instruction speed, wherein the control method comprises the steps of:

forming a relation between a necessary motor torque value in correspondence to a characteristic of the press machine and a value of a rotational angle of the rotating body, the necessary motor torque value being determined on the basis of a current supplied to the motor by executing a trial operation of the press machine;

detecting a rotational angle of the rotating body;

determining a necessary motor torque in correspondence to a value of the detected rotational angle on the basis of the value of the detected rotational angle and the relation; and increasing a rotational instruction speed of the motor to a value more than the fixed instruction speed, at the rotational angle of the rotating body in which the necessary motor torque becomes smaller than a predetermined motor torque reference value.

In the control method of the press machine in accordance with the present invention mentioned above, since it is possible to form the relation between the necessary motor torque value in correspondence to the characteristic of the press machine and the value of the rotational angle of the rotating body, the necessary motor torque value being obtained on the basis of the current supplied to the motor by executing the trial operation, determine the necessary motor torque corresponding to the rotational angle of the rotating body on the basis of the relation, and increase the rotational speed of the motor to a value more than the fixed instruction speed at the rotational angle of the rotating body in which the necessary motor torque becomes smaller than the predetermined motor torque reference value, it is possible to efficiently apply the rotational energy to the rotational system. Accordingly, it is possible to effectively lower the maximum motor torque.

Therefore, since it is possible to lower the maximum motor torque value, it is possible to make the electric capacities of the motor and the motor driving portion small, and it is possible to downsize the motor and the motor driving portion.

Further, since it is possible to efficiently apply the rotational energy to the rotational system, it is possible to lower the electric power consumption.

Further, it is possible to determine the necessary motor torque only by applying the detected rotational angle to the relation obtained by the trial operation.

In accordance with the present invention mentioned above, it is possible to downsize the motor and the motor driving circuit, and it is possible to lower the electric power consumption.

DESCRIPTION OF THE PREFERRED EMBODIMENTS

Figure 1:
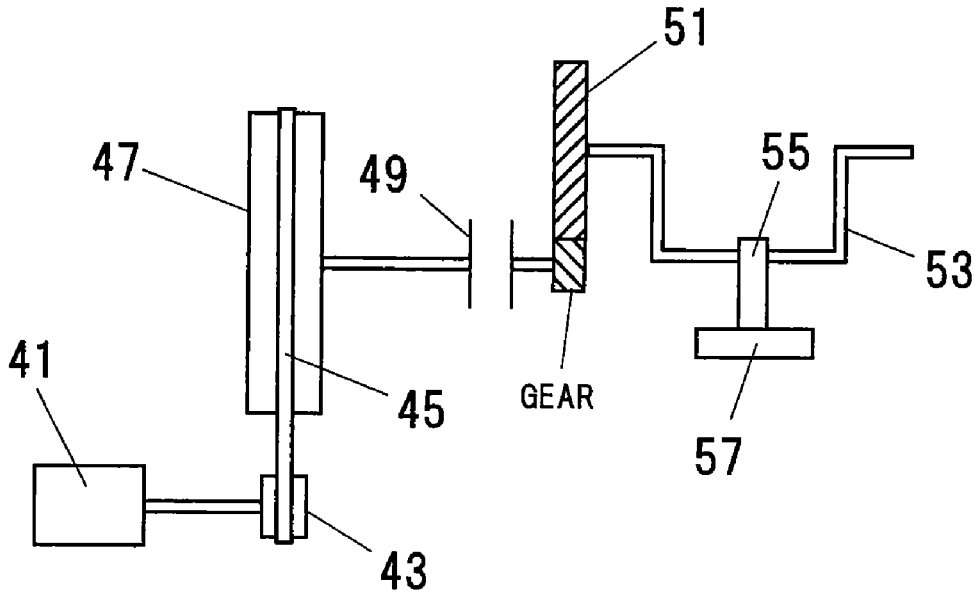
FIG. 1 is a view showing a structure of a conventional press machine using a flywheel.

A description will be given of preferable embodiments in accordance with the present invention with reference to the accompanying drawings. In this case, the same reference numerals are attached to common portions in each of the drawings, and an overlapping description will be omitted.

First Embodiment

Figure 2:
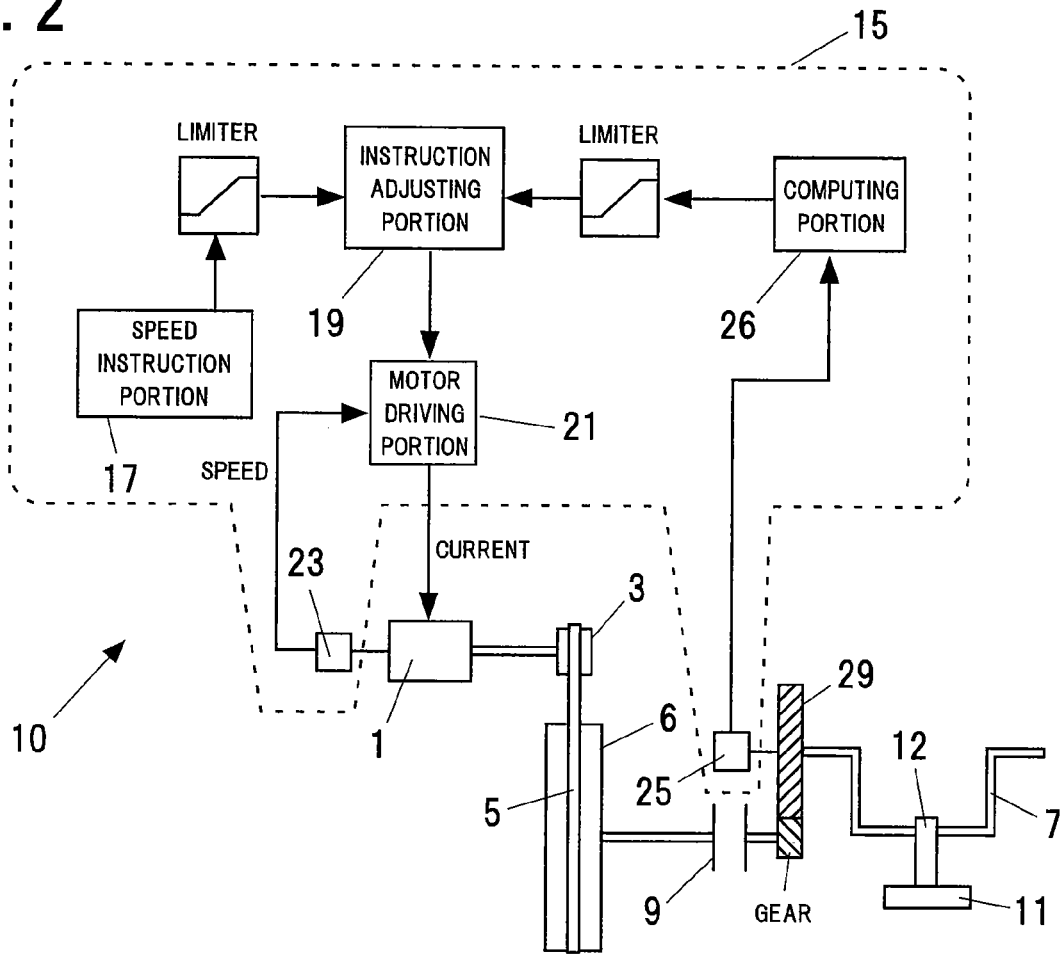
FIG. 2 is a view showing a structure of a press machine in accordance with a first embodiment of the present invention.

FIG. 2 is a view showing a structure of a press machine 10 in accordance with the present invention. As shown in FIG. 2, the press machine 10 is provided with a motor 1, a pulley 3 and a transmission belt 5 rotating in accordance with a rotational driving force of the motor 1, a flywheel 6 to which a driving force of the motor 1 is transmitted via the pulley 3 and the transmission belt 5 so as to be rotated, a crank shaft 7 to which a rotational driving force is transmitted from the flywheel 6, a clutch 9 coupling the flywheel 6 and the crank shaft 7 in an ON state and disconnecting the crank shaft 7 from the flywheel 6 in an OFF state, a slide 11 ascending and descending on the basis of the rotation of the crank shaft 7, and a coupling member 12 in which one end portion is coupled to an eccentric portion of the crank shaft 7 and the other end portion is coupled to the slide 11 so as to ascend and descend the slide 11.

An upper metal mold for the press is fixed to a lower surface of the slide 11, and a worked subject is pressed between the upper metal mold and a lower metal mold provided in a lower side of the slide 11, in the case that the slide 11 is descended.

Further, a control apparatus 15 controlling a rotational speed of the motor 1 is incorporated in the press machine 10. The control apparatus 15 has a speed instruction portion 17 outputting a rotational instruction speed value (hereinafter, refer to as an instruction speed value), for example, in correspondence to a press condition of the worked subject or the like input from the external side, and a motor driving portion 21 (for example, a drive circuit) receiving the instruction speed value from the speed instruction portion 17 and supplying a current corresponding to the instruction speed value to the motor 1. In this case, the instruction speed value from the speed instruction portion 17 is input to an instruction adjusting portion 19 via a limiter, in an example of FIG. 2.

First, a description will be given of a case that a fixed instruction speed value is input to the motor driving portion 21 from the speed instruction portion 17 without passing through the instruction adjusting portion 19.

In this case, the motor driving portion 21 supplies the current to the motor 1 on the basis of the input instruction speed value.

Further, the motor driving portion 21 receives a detected value from an angular velocity sensor 23 such as a tachogenerator or the like detecting a rotational speed of the motor 1, determines whether or not the detected rotational speed of the motor 1 agrees with the instruction speed value, and adjusts the current to the motor 1 if the speed is different. Accordingly, the detected rotational speed of the motor 1 is controlled in such a manner as to agree with the fixed instruction speed value.

Figure 3:
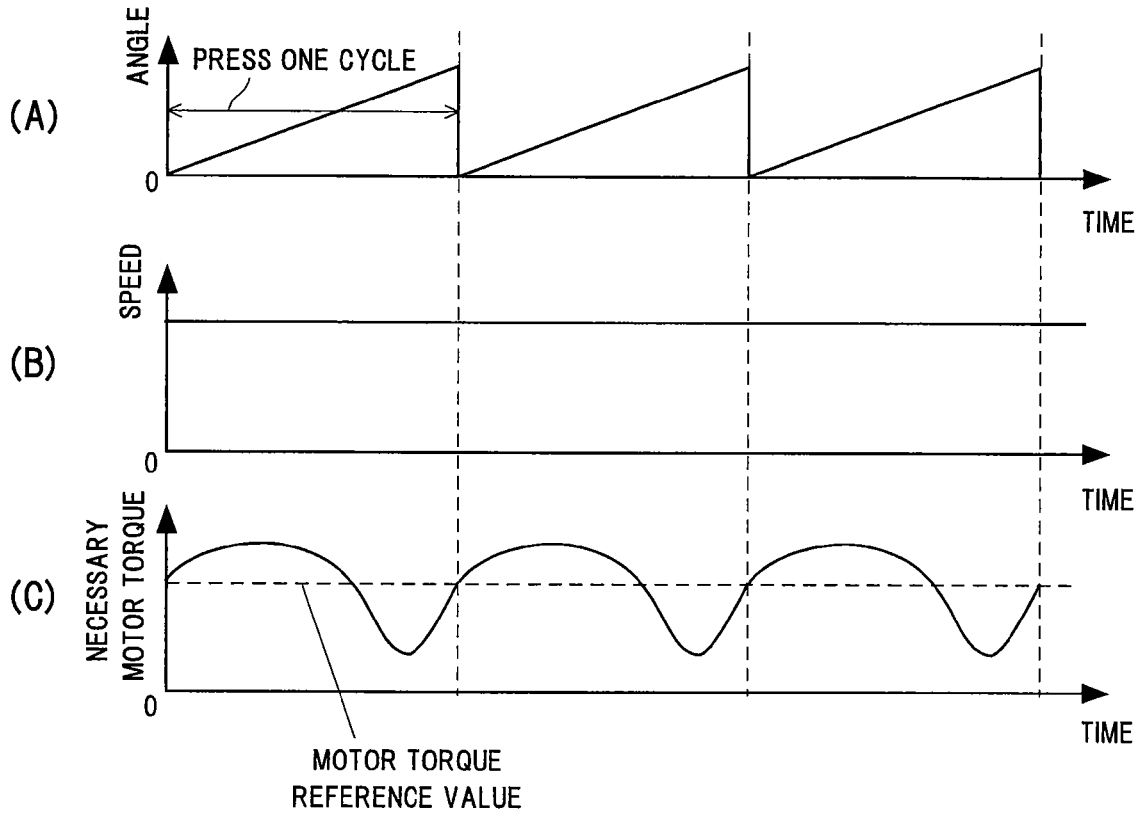
FIG. 3 is a view showing a rotational angle of a crank shaft, an instruction speed value and a necessary motor torque fluctuation with respect to a time, in the case of rotating a motor at a fixed speed.

FIG. 3 is a graph showing a necessary torque fluctuation of the motor 1 in the case of rotating the motor 1 at a fixed instruction speed (that is, a fixed speed) so as to operate the press machine 10, as mentioned above. In the present specification and claims, the necessary motor torque is a torque of the motor 1 which is determined by a characteristic of the press machine, the press worked subject, a desired fixed rotational speed of the crank shaft 7, or the like.

In (A) of FIG. 3, a horizontal axis indicates a time, and a vertical axis indicates a rotational angle of the crank shaft 7. Since the rotational angle of the crank shaft 7 changes from 0 to 360 degree per one cycle of the press, the same waveform is repeated over cycles of the press.

In (B) of FIG. 3, the horizontal axis indicates a time, and a vertical axis indicates an instruction speed value output by the speed instruction portion 17. In this case, the instruction speed value is fixed.

(C) of FIG. 3 shows a necessary torque fluctuation of the motor 1 in the case of rotating the motor 1 at a fixed instruction speed to operate the press machine 10. As shown in this drawing, if the crank shaft 7 is rotated at the fixed instruction speed in (B) of FIG. 3 by the motor 1, the necessary torque of the motor 1 is fluctuated in accordance with the time on the basis of the various mechanical factors coupled to the crank shaft 7. In other words, a motor performance torque of the press machine is fluctuated in accordance with the rotational angle of the crank shaft 7.

The press machine 10 in accordance with the first embodiment is further provided with an angle sensor 25 such as a rotary encoder or the like detecting a rotational angle of a main gear 29 coupled to one end portion of the crank shaft 7, as shown in FIG. 2.

The control apparatus 15 executes a control for increasing the rotational instruction speed of the motor 1 more than a fixed instruction speed in (B) of FIG. 3 at a rotational angle of the crank shaft 7 at which the necessary torque of the motor becomes smaller than a motor torque reference value shown in (C) of FIG. 3 in the case of rotating the motor 1 at the fixed instruction speed as shown in (B) of FIG. 3. Accordingly, since it is possible to efficiently apply the rotational energy to the rotating system, it is possible to effectively descend a maximum motor torque value. Accordingly, since it is possible to reduce the maximum motor torque value, it is possible to make electric capacities of the motor 1 and the motor driving portion 21, and it is possible to downsize the motor 1 and the motor driving portion 21. Further, since it is possible to efficiently apply the rotational energy to the rotating system, it is possible to lower an electric power consumption.

In the present specification and claims, the motor torque reference value may be an average value over one cycle of the fluctuating necessary torque shown by a solid line in (C) of FIG. 3 or an average value of the necessary motor torque over a predetermined time. However, the motor torque reference value is not limited to this, and may be a fixed value which is larger than a minimum value of the necessary motor torque shown by the solid line in (C) of FIG. 3 and smaller than a maximum value of the necessary motor torque shown by a solid line in (C) of FIG. 3.

Further, the control apparatus 15 descends the rotational instruction speed of the motor 1 less than the fixed instruction speed, at the rotational angle of the crank shaft 7 at which the necessary motor torque becomes larger than the motor torque reference value in the case of rotating the motor 1 at the fixed instruction speed mentioned above. Accordingly, it is possible to further lower the maximum motor torque value.

A description will be in detail given below of the press machine 10 executing the control mentioned above.

As shown in FIG. 2, the control apparatus 15 of the press machine 10 in accordance with the first embodiment is further provided with a computing portion 26 outputting a speed adjustment value of the motor 1 in correspondence to an output value from an angle sensor 25, and an instruction adjusting portion 19 increasing and decreasing the instruction speed value input from the speed instruction portion 17 by a degree of the speed adjustment value input from the computing portion 26. The instruction adjusting portion 19 outputs the instruction speed value which was adjusted so as to be ascended and descended as mentioned above, to the motor driving portion 21. In the example, in FIG. 2, the speed adjustment value from the computing portion 26 is input to the instruction adjusting portion 19 via the limiter.

The angle sensor 25 detects the rotational angle of the crank shaft 7 by detecting the rotational angle of the main gear 29 coupled to the crank shaft 7 so as to continuously output a detection value.

The computing portion 26 functions as a speed adjustment function calculating the speed adjustment value for increasing and decreasing the rotational instruction speed of the motor 1 in correspondence to the input value of the rotational angle of the crank shaft 7.

Figure 4:
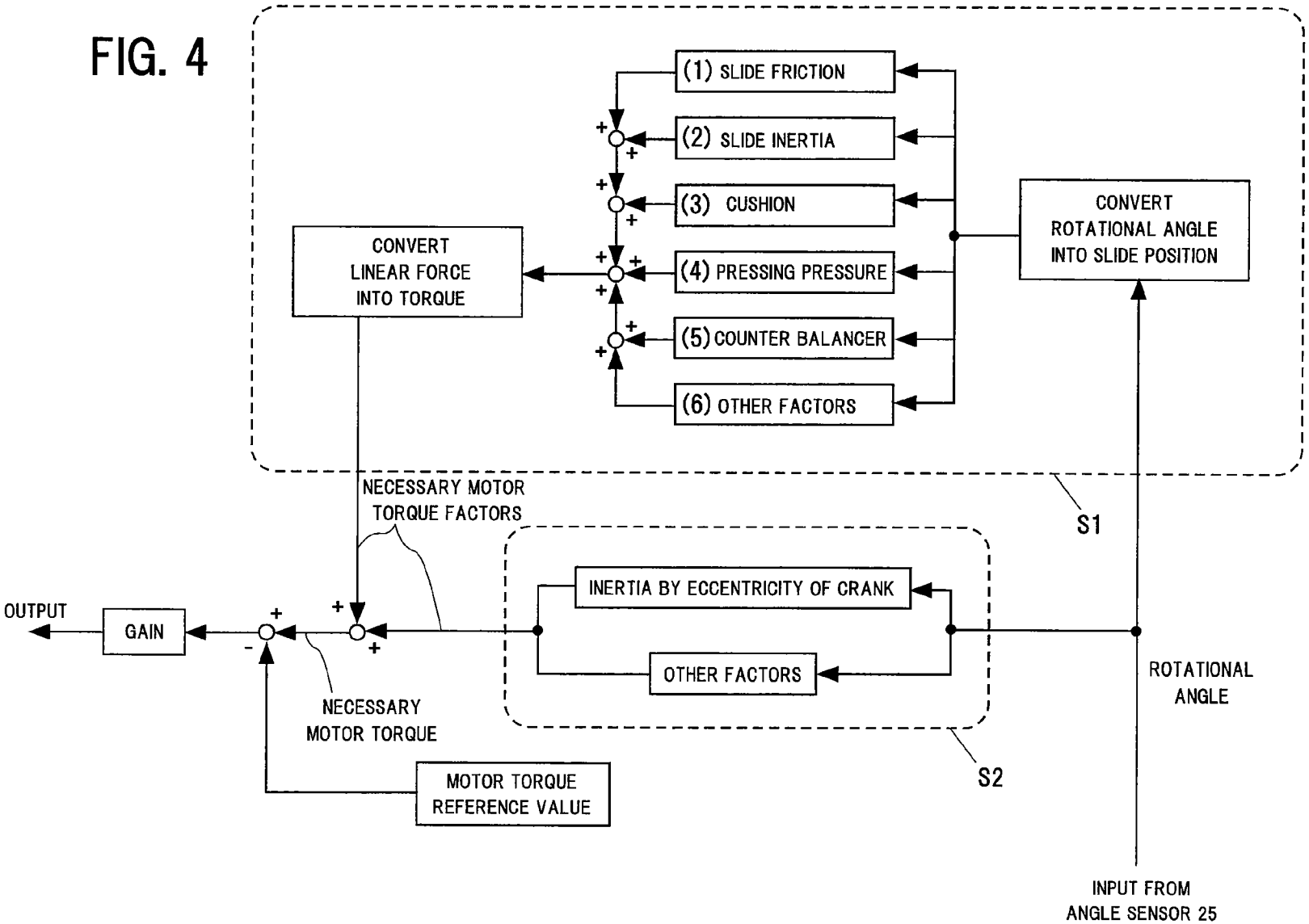
FIG. 4 is a view showing a flow of a process of a computing portion in accordance with the first embodiment of the present invention.

FIG. 4 is a view showing a flow from the input to the function to the output.

If the value of the rotational angle is input to the computing portion 26, that is the speed adjustment function, from the angle sensor 25, the computing portion 26 first calculates a fluctuation factor of the necessary motor torque caused by a reciprocating motion of the slide, and a fluctuation factor of the necessary motor torque caused by the rotational motion of the crank shaft, on the basis of this input.

1. calculation of necessary motor torque fluctuation factor caused by reciprocating motion of slide If the value of the rotational angle is input for calculating the necessary motor torque fluctuation factor caused by the reciprocating motion of the slide (shown by reference symbol S1 in FIG. 4), the rotational angle is converted into a position of the slide 11.

Further, the necessary motor torque fluctuation factor caused by the reciprocating motion of the slide is calculated on the basis of the information of the slide position.

The torque fluctuation factor calculation is executed with regard to the following factors (1) to (6).

(1) Slide Friction

The slide friction is determined as a product of a dynamic friction coefficient of the slide and a speed of the slide. In this case, since the speed of the slide is changed in accordance with the rotational angle of the crank shaft, a frictional force of the slide is changed in accordance with the rotational angle of the crank shaft.

(2) Inertia of Slide

The inertia of the slide is determined as a product of a weight of the slide and an acceleration of the slide. In this case, since the acceleration of the slide is changed in accordance with the rotational angle of the crank shaft, the inertia of the slide is also changed in accordance with the rotational angle of the crank shaft.

(3) Cushion

A force which a die cushion applies to the slide is determined on the basis of a cushion force set only while the die cushion is actuated at a time of pressing. In this case, the force which the die cushion applies to the slide is changed in accordance with the rotational angle of the crank shaft.

(4) Pressing Pressure

The press is modeled as a spring, and the pressing pressure generated only while the spring is compressed (that is, only while the upper metal mold and the lower metal mold are in contact with each other) is determined as a product of a spring constant and a compressing amount. In this case, the pressing pressure is changed in accordance with the rotational angle of the crank shaft.

(5) Counter Balancer

In order to balance with a force applied to the slide 11 due to its own weight of the slide 11 and its own weight of the mechanical element coupled to the slide 11, there is a case that the press machine 10 is provided with a counter balancer applying an upward or downward force to the slide 11.

The counter balancer is constituted by a pneumatic cylinder or the like, and a magnitude of a force which the counter balance applies to the slide 11 is fluctuated by the position of the slide 11, that is, the rotational angle of the crank shaft 7.

(6) Other Factors

In the case that the other factors applying the force to the reciprocating slide 11 exist in addition to the factors mentioned above, these factors are considered as well.

With regard to the factors (1) to (6) mentioned above, the respective forces applied to the slide 11 are previously determined as the function of the rotational angle of the crank shaft.

If the linear forces applied to the slide 11 in correspondence to the input rotational angle with regard to the factors (1) to (6), these linear forces are added as shown in FIG. 4. Subsequently, the added linear force is converted into the necessary torque factor of the motor.

2. calculation of fluctuation factor of necessary motor torque caused by rotational motion of crank shaft On the other hand, a calculation of the fluctuation factor of the necessary motor torque caused by the rotational motion of the crank shaft (shown by reference symbol S2 in FIG. 4) is also executed. This calculation determines the necessary motor torque factor generated by converting the rotational motion into the reciprocating motion of the slide as a function of the rotational angle of the crank shaft. In the case of the present embodiment, the necessary motor torque fluctuation factor generated due to the eccentricity of the crank shaft is determined as the function of the rotational angle of the crank shaft.

The necessary motor torque fluctuation factor is previously determined as the function of the rotational angle of the crank shaft, and the value of the necessary motor torque factor is calculated in correspondence to the input rotational angle in accordance with the function.

As mentioned above, if the necessary motor torque factor caused by the reciprocating motion of the slide 11, and the necessary motor torque fluctuation factor caused by the rotational motion of the crank shaft are calculated in correspondence to the input rotational angle, the necessary motor torque is calculated by adding them, as shown in FIG. 4.

Figure 5:
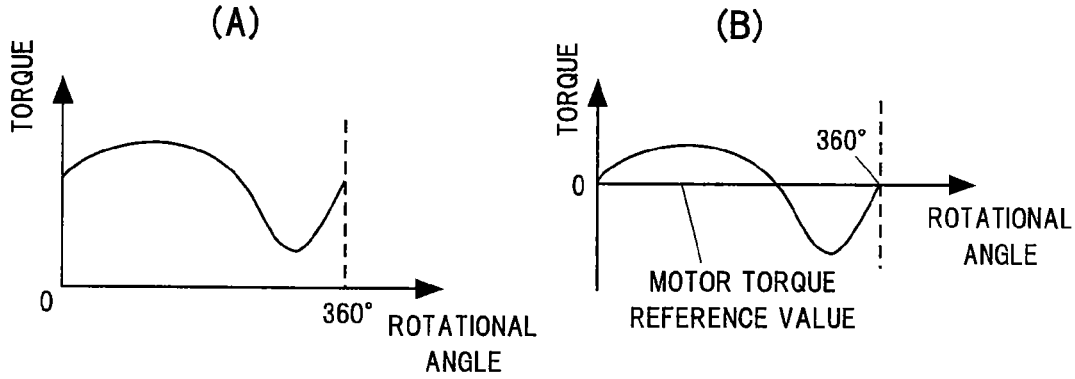
FIG. 5 is a view showing a necessary motor torque fluctuation over one cycle of a rotation of the crank shaft.

(A) of FIG. 5 shows an example of the necessary motor torque. In this drawing, a horizontal axis indicates the rotational angle of the crank shaft, and a vertical axis indicates a torque fluctuation rate with no unit.

Subsequently, there is calculated a difference between a necessary motor torque corresponding to a total of the necessary motor torque factor caused by the reciprocating motion of the slide 11, and the necessary motor torque fluctuation factor caused by the rotational motion of the crank shaft, and a motor torque reference value as a torque fluctuation value.

(B) of FIG. 5 shows a torque fluctuation value taken out as mentioned above. In this drawing, a horizontal axis indicates the rotational angle of the crank shaft, and a vertical axis indicates the torque fluctuation rate with no unit.

Preferably, a position of the horizontal axis (that is, the motor torque reference value) is defined as shown in (B) of FIG. 5 in such a manner that a value obtained by integrating the necessary motor torque expressed by the function shown in (A) of FIG. 5 by the rotational angle over one cycle (0 to 360 degree) of the rotational angle of the crank shaft 7 becomes zero. Accordingly, in this case, the position of the horizontal axis is defined in such a manner that an average value of the necessary motor torque over one cycle of the rotation of the crank shaft 7 becomes zero.

Next, the torque fluctuation value corresponding to the difference between the necessary motor torque and the motor torque reference value is multiplied by a fixed gain (magnification) so as to be output as a speed adjustment value.

As shown in FIG. 4, if the rotational angle of the crank shaft 7 is input to the computing portion 26 in accordance with the procedure mentioned above, the speed adjustment value is output from the computing portion 26.

As mentioned above, in accordance with the present invention, the necessary motor torque is calculated in correspondence to the characteristic of the press machine 10, and the speed adjustment value is calculated in correspondence to the necessary motor torque.

In the present embodiment, the speed adjustment value is calculated in such a manner as to increase the rotational instruction speed of the motor 1 more than the fixed instruction speed, at the rotational angle of the crank shaft 7 at which the necessary motor torque becomes smaller than the motor torque reference value in the case of rotating the motor 1 at the fixed instruction speed mentioned above.

Further, the speed adjustment value is calculated in such a manner as to decrease the rotational instruction speed of the motor 1 to a value less than the fixed instruction speed, at the rotational angle of the crank shaft 7 at which the necessary motor torque becomes larger than the motor torque reference value in the case of rotating the motor 1 at the fixed instruction speed mentioned above.

In the example in FIG. 4, the speed adjustment function of the computing portion 26 is formed in such a manner as to output the speed adjustment value having the magnitude of the value obtained by multiplying the torque fluctuation value at the input rotational angle by the fixed gain, if the rotational angle of the crank shaft 7 is input, as shown in (B) of FIG. 5. In this case, the output value of the speed adjustment function is positive with respect to the rotational angle at which the necessary motor torque becomes smaller than the motor torque reference value in the case of rotating the motor 1 at the fixed instruction speed. On the other hand, the output value of the speed adjustment function is negative with respect to the rotational angle at which the necessary motor torque becomes larger than the motor torque reference value in the case of rotating the motor 1 at the fixed instruction speed. Further, in the case of setting the gain to the fixed positive value, as the necessary motor torque shown in (C) of FIG. 3 or FIG. 5 becomes smaller or larger than the motor torque reference value, an absolute value of the output value of the speed adjustment function at that rotational angle becomes larger.

The speed adjustment function mentioned above can be constructed, for example, by an electronic circuit incorporated in the computing portion 26.

The computing portion 26 serving as the speed adjustment function applies the rotational angle to the speed adjustment function if the rotational angle of the crank shaft 7 detected by the angle sensor 25 is input, and calculates the speed adjustment value corresponding to the rotational angle. The speed adjustment value calculated by the computing portion 26 is output to the instruction adjusting portion 19.

The instruction adjusting portion outputs the instruction speed value which is adjusted so as to be increased and decreased by adding the speed adjustment value from the computing portion 26 to the fixed instruction speed value from the speed instruction portion 17.

The instruction speed value is input to the motor driving portion 21, and the motor driving portion 21 adjusts the electric current supplied to the motor 1 in such a manner that the rotational speed of the motor 1 agrees with the input instruction speed value. This adjustment can be executed by using the speed sensor 23 as mentioned above.

In accordance with the control mentioned above, the rotational instruction speed of the motor 1 is increased at the rotational angle of the crank shaft 7 at which the necessary torque is small in (C) of FIG. 3, and the rotational instruction speed of the motor 1 is decreased at the rotational angle of the crank shaft 7 at which the necessary motor torque is large in (C) of FIG. 3.

Figure 6:
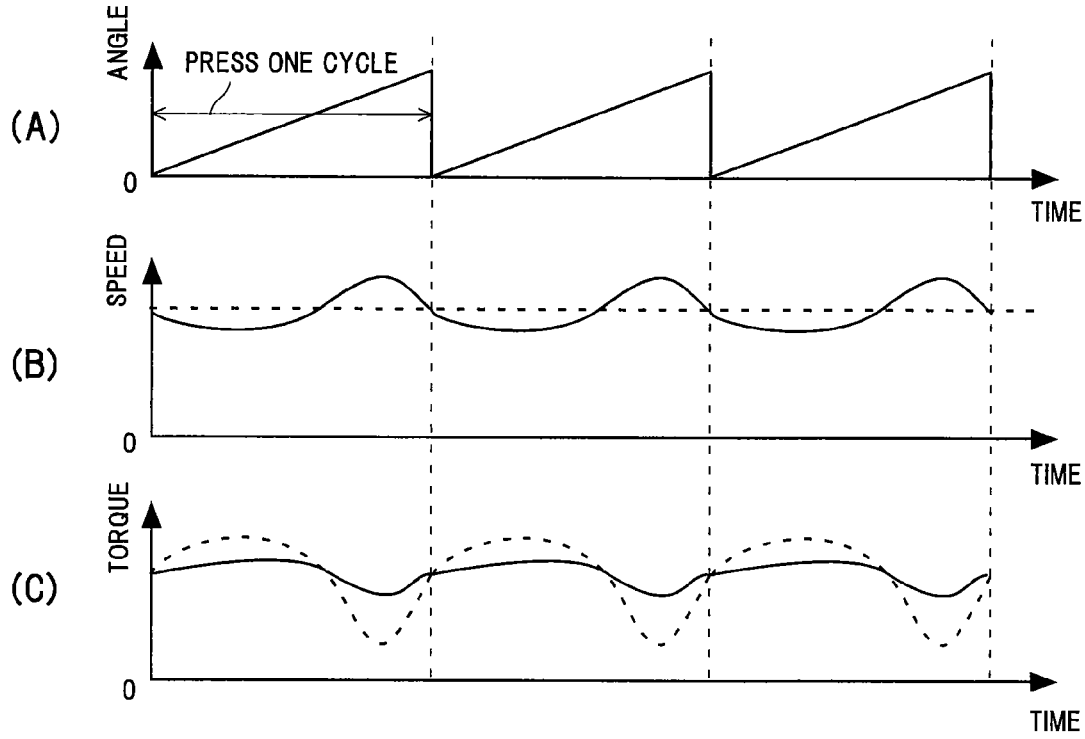
FIG. 6 is a view showing an angle of the crank shaft, an adjusted instruction speed value, and a torque fluctuation in the case of adjusting the rotational speed.

(B) of FIG. 6 shows a time change of the instruction speed value adjusted as mentioned above. Further, (C) of FIG. 6 shows a motor torque fluctuation in this case. A broken line in (B) of FIG. 6 shows a fixed instruction speed value in (B) of FIG. 3 for comparison, and a broken line in (C) of FIG. 6 shows the necessary motor torque fluctuation of (C) of FIG. 3. (A) of FIG. 6 shows a time change or the rotational angle of the crank shaft 7 corresponding to (A) of FIG. 3.

It is possible to efficiently apply the rotational energy to the rotating system by adjusting the speed as shown in (B) of FIG. 6, it is possible decrease the maximum motor torque value and it is possible to lower the fluctuation of the motor torque, as shown in (C) of FIG. 6.

As mentioned above, since it is possible to lower the maximum motor torque value, it is possible to make the electric capacities of the motor and the motor driving portion small, and it is possible to downsize the motor and the motor driving portion.

Further, since it is possible to efficiently apply the rotational energy to the rotating system, it is possible to lower the electric power consumption.

Further, preferably, a time integral value over one cycle (0 to 360 degree) of the rotational angle of the crank shaft 7 is equal between the amount at which the rotational instruction speed of the motor is increased from the fixed instruction speed mentioned above, and the amount at which the rotational instruction speed of the motor is decreased from the fixed instruction speed mentioned above, in accordance with the speed adjustment function mentioned above. Accordingly, since the amount increasing the rotational instruction speed and the amount decreasing the rotational instruction speed are equal in the time integral value over one cycle of the rotational angle, it is possible to align the press operation time over one cycle of the rotational angle with the press operation time over one cycle of the rotational angle in the case of rotating the motor at the fixed instruction speed, and it is possible to prevent the press production speed from being lowered.

Second Embodiment

Figure 7:
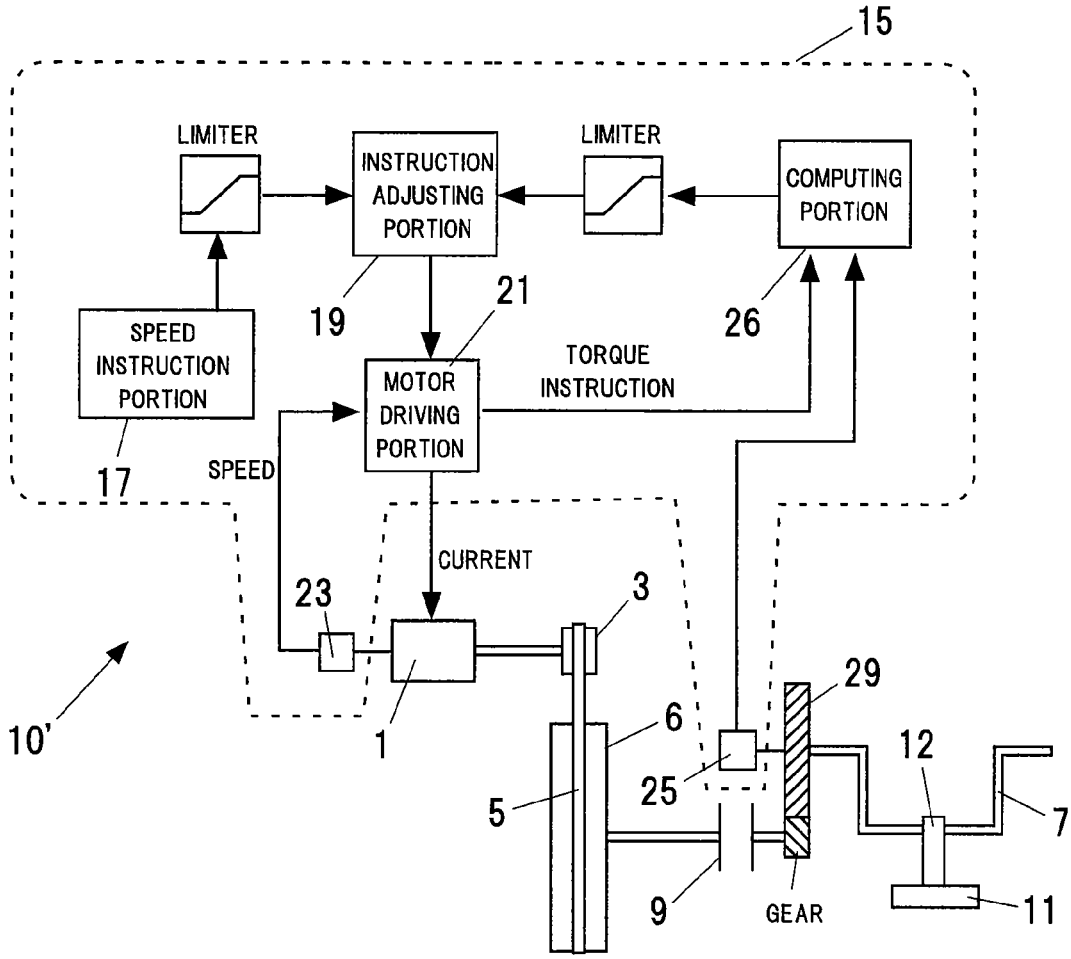
FIG. 7 is a view showing a structure of a press machine in accordance with a second embodiment of the present invention.

FIG. 7 is a view of a structure of a press machine 10' in accordance with a second embodiment of the present invention. In the press machine 10' in accordance with the second embodiment, the structure is made such that the value of the instruction torque is input to the computing portion 26 from the motor driving portion 21, and the structure of the computing portion 26 is different from the case of the first embodiment. The other structures of the press machine 10' in accordance with the second embodiment are the same as the case of the first embodiment.

In the same manner as mentioned above, the motor driving portion 21 receives the instruction speed value from the speed instruction portion 17 directly or via the instruction adjusting portion 19, and supplies the electric current of the value corresponding thereto to the motor 1. At this time, an actual speed value of the motor 1 is input to the motor driving portion 21 from the speed sensor 23, and the current value to the motor 1 is feedback controlled in such a manner that the actual speed of the motor 1 agrees with the instruction speed value.

Figure 8:
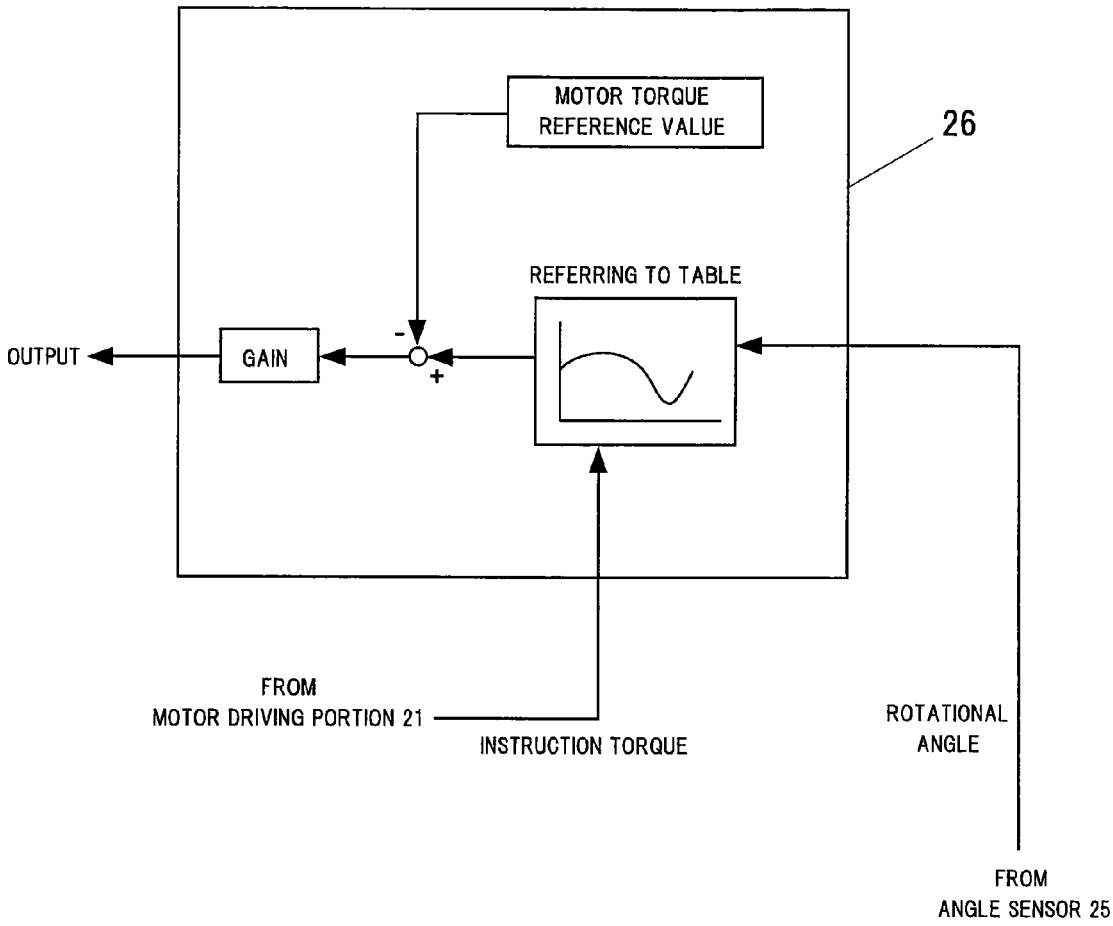
FIG. 8 is a view showing a flow of a process of a computing portion in accordance with the second embodiment of the present invention.

FIG. 8 shows the structure of the computing portion 26 in accordance with the second embodiment.

In accordance with the second embodiment, in a state where the fixed instruction speed value is input to the motor driving portion 21 from the speed instruction portion 17 without passing through the instruction adjusting portion 19, the trial operation of the press machine 10' is executed. In this trial operation, the worked subject is actually pressed. The trial operation may be executed over a first cycle or some cycles of the press producing operation.

At a time of the trial operation, the instruction torque value is input to the computing portion 26 from the motor driving portion 21, and the rotational angle of the crank shaft 7 is input to the computing portion 26 from the angle sensor 25.

The instruction torque value input to the computing portion 26 from the motor driving portion 21 corresponds to a value of the necessary motor torque corresponding to the value of the electric current which the motor driving portion 21 supplies to the motor 1, may be a value in proportion to the current value, and is calculated from the value of the electric current supplied to the motor 1.

A relation between the rotational angle of the crank shaft 7 and the instruction torque value is obtained by the trial operation of the press machine 10', and is formed as a table. Accordingly, it is possible to obtain the instruction torque value with respect to each of the rotational angles of the crank shaft 7 by referring to the formed table.

A description will be given of the table formation in the case of an operating method of executing the operation while stopping the press at a top dead center every time.

In this operating method, one cycle is set such that the slide 11 starts operating from a state of stopping at the top dead center and again returns to the top dead center so as to stop, and this operation is repeated. In this case, since the clutch 9 is turned on and off every one cycle, the clutch 9 affects in the same manner every cycle, and the same torque value is repeated over cycles.

Accordingly, the relation between the rotational angle of the crank shaft 7 and the instruction torque value may be obtained over optional one cycle to formed the table. Alternatively, data relating to the relation mentioned above obtained over some cycles are averaged per each of angles to form the data for one cycle so as to form the table.

A description will be given of the table formation in the case of the operating method of continuously operating the press without stopping the press at the top dead center.

In this operating method, the slide 11 is continuously operated without being stopped at the top dead center, after starting the operation, and the slide 11 is not stopped at the top dead center per one cycle. In this case, since the clutch 9 is not disconnected after the clutch 9 is connected, after starting the operation, the instruction torque value is different between the first one cycle and the thereafter cycle.

Accordingly, the data for some cycles (for example, n cycles) until the instruction torque value becomes stable are obtained by the trial operation, and the table mentioned above showing the instruction torque fluctuation over some cycles is formed. The data in each of the cycles of the table are applied to the corresponding cycle at a time of the actual operation. Further, the data in the final cycle (n cycle) of the table are applied repeatedly to the cycles after the n cycle, at a time of the actual operation.

Alternatively, the data for a cycle after the instruction torque value becomes stable by trial press operation may be obtained to form the table. The data of the table expressing the relation at the stable time may be repeatedly applied to each of the cycles from the starting time in the actual operation.

As mentioned above, if the table is formed by the trial operation of the press machine 10', the table is stored in the computing portion 26, and the actual operation of the press machine 10' is executed as follows.

If the rotational angle of the crank shaft 7 is input to the computing portion 26 from the angle sensor 25 at a time of operating, the computing portion 26 applies the input rotational angle to the table and calculates the necessary motor torque value corresponding to the input rotational angle.

Subsequently, in the same manner as the case of the first embodiment, the computing portion 26 calculates the difference between the necessary motor torque and the motor torque reference value, thereafter multiplies the difference by the fixed gain, and output the multiplied value as the speed adjustment value. Since the thereafter operations are the same as those of the first embodiment, a description thereof will be omitted. In this case, at a time of the actual operation of the press machine 10', the instruction torque value may not be input to the computing portion 26 from the motor driving portion 21.

In the second embodiment, it is possible to determine the necessary motor torque only by applying the detected rotational angle to the table obtained by the trial operation, and it is possible to adjust the rotational instruction speed of the motor on the basis of the simple structure and process.

Third Embodiment

Figure 9:
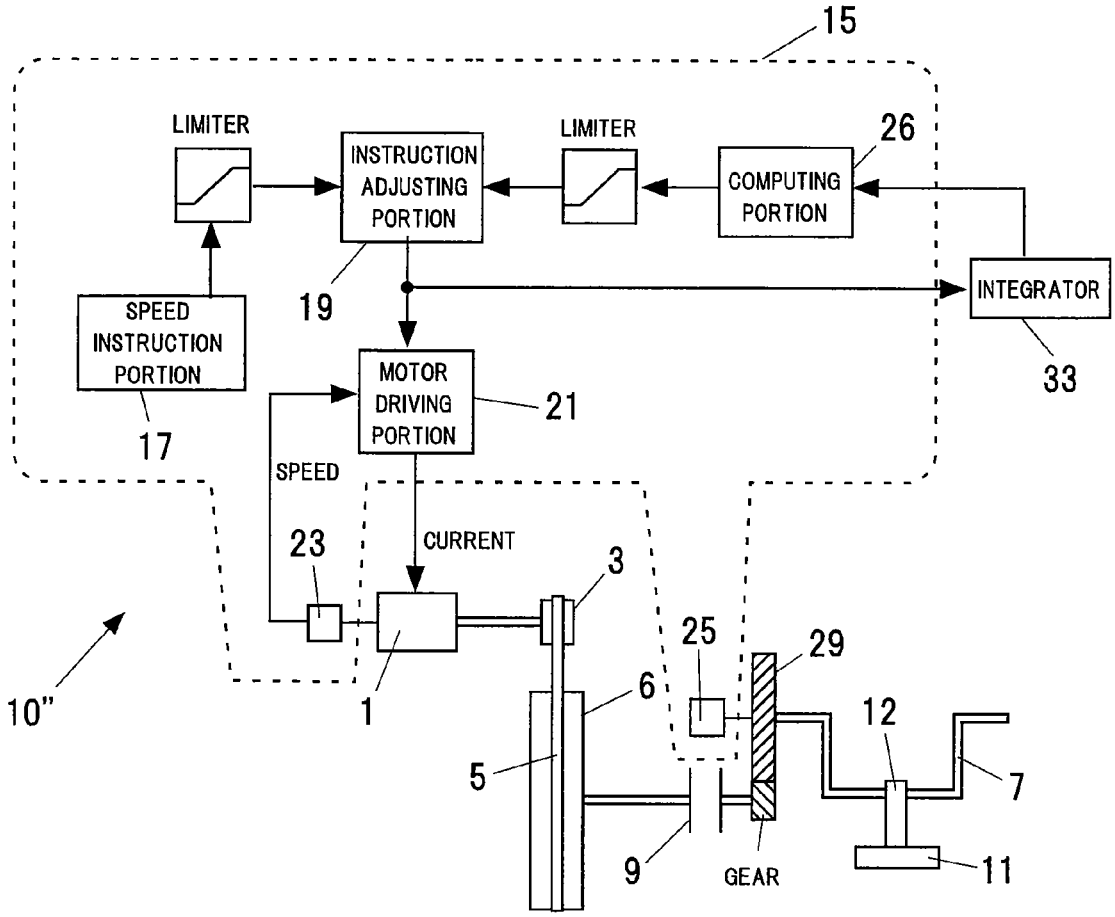
FIG. 9 is a view showing a structure of a press machine in accordance with a third embodiment of the present invention.

FIG. 9 is a view of a structure of a press machine 10" in accordance with a third embodiment of the present invention. In the third embodiment, an integrator 33 is used in place of the angle sensor 25 in FIG. 2 described in the first embodiment or the second embodiment. The other structures are the same as those of the press machine 10 in accordance with the first embodiment, and FIG. 9 describes the structures corresponding to the first embodiment. However, in the case that the structure of the third embodiment is made such as to correspond to the second embodiment, the structure is made such that the instruction torque is input to the computing portion 26 from the motor driving portion 21 at a time of the trial operation.

As shown in FIG. 9, the adjusted instruction speed value from the instruction adjusting portion 19 is input to the integrator 33, and the integrator 33 integrates the input instruction speed value by the time.

If the instruction speed value is integrated by the time from the time of starting the motor drive, it is possible to obtain the rotational angle of the motor 1 at the present time.

The value of the rotational angle of the motor 1 at the present time obtained by the integrator 33 as mentioned above is input to the computing portion 26. The computing portion 26 outputs the speed adjustment value on the basis of the value of the rotational angle input from the integrator 33. The other structures and operations are the same as those of the case of the first embodiment.

In accordance with the third embodiment, it is possible to detect the rotational angle of the motor 1 by time integrating the instruction speed value by the integrator 33 even if the angle sensor 25 detecting the rotational angle of the main gear 29 such as the first embodiment is not provided.

Accordingly, since the angle sensor 25 can be omitted, the structure can be made simple.

Fourth Embodiment

In the first embodiment or the second embodiment, the computing portion 26 outputs the speed adjustment value added to the instruction speed value from the speed instruction portion 17, however, in the fourth embodiment, the computing portion 26 outputs an adjustment gain value (magnification) multiplied by the instruction speed value from the speed instruction portion 19.

The instruction adjusting portion 19 outputs the instruction speed value adjusted by multiplying the instruction speed value input from the speed instruction portion 17 by the adjustment gain input from the computing portion 26.

The adjustment gain calculated by the computing portion 26 that is multiplied by the instruction speed value from the speed instruction portion 17 may be set such that the adjustment amount by the adjustment gain results in the same as that in the first embodiment or the second embodiment shown in (B) of FIG. 6.

In other words, the adjustment gain calculated by the computing portion 26 is changed in correspondence to the value of the rotational angle input to the computing portion 26. The adjustment gain takes a smaller value at the value of the necessary motor torque shown in (C) of FIG. 3 in the input rotational angle that is larger than the reference motor torque value, and takes a larger value at the value of the necessary motor torque shown in (C) of FIG. 3 in the input rotational angle that is smaller than the reference motor torque value.

Other Embodiments

The angle detecting apparatus is constituted by the angle sensor 25 detecting the rotational speed of the main gear 29 mentioned above, or the integrator 33 time integrating the instruction speed value input to the motor driving portion 21, however, may be structured by the other suitable means. For example, the angle detecting apparatus may be structured by an angular velocity detecting apparatus or an apparatus detecting the position or the speed of the slide 11.

In the computing portion 26 in accordance with the first embodiment or the second embodiment, the portion calculating the necessary motor torque on the basis of the input rotational angle of the crank shaft 7 constitutes the torque determining apparatus. Further, in the computing portion 26 and the instruction adjusting portion 19 in accordance with the first embodiment and the second embodiment, the portion calculating the adjusted instruction speed value on the basis of the calculated necessary motor torque constitutes the speed adjusting apparatus.

However, the torque determining apparatus is not limited to the structure in accordance with the embodiments mentioned above, and may employ any apparatus for determining the necessary motor torque in correspondence to the characteristic of the press machine on the basis of the input value of the rotational angle, and may be structured by a suitable means such as an electronic circuit or the like so as to achieve the function.

Further, the speed adjusting apparatus is not limited to the structures in accordance with the embodiments mentioned above, and may be structured by any apparatus which increases the rotational instruction speed of the motor more than the fixed instruction speed at the rotational angle of the rotating body (for example, the crank shaft 7) in which the necessary motor torque becomes smaller than the predetermined motor torque reference value, or decreases the rotational instruction speed of the motor less than the fixed instruction speed at the rotational angle of the rotating body in which the necessary motor torque becomes larger than the predetermined motor torque reference value, and may be structured by a suitable means such as an electronic circuit or the like so as to achieve this function.

Further, in the structure mentioned above, in order to align the operating time per one cycle of the crank shaft rotation, the amount at which the rotational instruction speed of the motor is increased from the fixed instruction speed, and the amount at which the rotational speed of the motor is decreased from the fixed instruction speed are set such that the time integral value over one cycle (0 to 360 degree) of the rotational angle of the crank shaft 7 is equal. However, the instruction speed value may be adjusted in such a manner that these time integrals over a suitable predetermined time (for example, for one minute) are equal in correspondence to various conditions and states.

The crank shaft 7 mentioned above corresponds to the rotating body, and the crank shaft 7, the coupling member 12 coupled thereto and the like constitutes the converting mechanism of converting the rotational motion of the motor 1 into the reciprocating motion of the slide 11, however, the converting mechanism may be structured by the cam rotationally driven by the motor 1, the other suitable members or the like.

Further, the description is given of the press machines 10, 10' and 10" using the flywheel in the embodiments mentioned above, however, the present invention can be applied to the press machine executing the operation by the servo motor without using the flywheel.

As mentioned above, it goes without saying that the present invention is not limited to the embodiments mentioned above, but can be variously modified within the scope of the present invention.

What is claimed is:

1. A control apparatus of a press machine, the press machine comprising:

(a) a motor;

(b) a converting mechanism having a rotating body rotationally driven by the motor and converting a rotational motion into a reciprocating motion;

(c) a slide coupled to the converting mechanism and reciprocating a motor performance torque that is fluctuated in accordance with a rotational angle of the rotating body when rotating the motor at a fixed instruction speed; and (d) the control apparatus comprising i. an angle detecting apparatus disposed to detect a rotational angle of the rotating body;

ii. a torque determining apparatus disposed to determine a necessary motor torque in correspondence to a characteristic of the press machine on a basis of a value of the rotational angle input from the angle detecting apparatus; and iii. a speed adjusting apparatus increasing the rotational instruction speed of the motor to a value more than the fixed instruction speed, at the rotational angle of the rotating body in which the necessary motor torque becomes smaller than a predetermined motor torque reference value, wherein the predetermined motor torque reference value is an average value over one cycle of the fluctuating necessary torque, or an average value of the necessary motor torque over a predetermined time, or a fixed value that is larger than a minimum value of the necessary motor torque and smaller than a maximum value of the necessary motor torque.

2. A control apparatus of a press machine, the press machine comprising:

(a) a motor;

(b) a converting mechanism having a rotating body rotationally driven by the motor and converting a rotational motion into a reciprocating motion;

(c) a slide coupled to the converting mechanism and reciprocating a motor performance torque that is fluctuated in accordance with a rotational angle of the rotating body when rotating the motor at a fixed instruction speed; and (d) the control apparatus i. an angle detecting apparatus disposed to detect a rotational angle of the rotating body;

ii. a torque determining apparatus disposed to determine a necessary motor torque in correspondence to a characteristic of the press machine on a basis of a value of the rotational angle input from the angle detecting apparatus; and iii. a speed adjusting apparatus decreasing the rotational instruction speed of the motor to a value less than the fixed instruction speed, at the rotational angle of the rotating body in which the necessary motor torque becomes larger than a predetermined motor torque reference value, wherein the predetermined motor torque reference value is an average value over one cycle of the fluctuating necessary torque, or an average value of the necessary motor torque over a predetermined time, or a fixed value that is larger than a minimum value of the necessary motor torque and smaller than a maximum value of the necessary motor torque.

3. A control apparatus of a press machine, the press machine comprising:

(a) a motor;

(b) a converting mechanism having a rotating body rotationally driven by the motor and converting a rotational motion into a reciprocating motion;

(c) a slide coupled to the converting mechanism and reciprocating a motor performance torque that is fluctuated in accordance with a rotational angle of the rotating body when rotating the motor at a fixed instruction speed; and (d) the control apparatus comprises i. an angle detecting apparatus disposed to detect a rotational angle of the rotating body;

ii. a torque determining apparatus disposed to determine a necessary motor torque in correspondence to a characteristic of the press machine on a basis of a value of the rotational angle input from the angle detecting apparatus; and iii. a speed adjusting apparatus increasing the rotational instruction speed of the motor to a value more than the fixed instruction speed, at the rotational angle of the rotating body in which the necessary motor torque becomes smaller than a predetermined motor torque reference value, and decreasing the rotational instruction speed of the motor to a value less than the fixed instruction speed, at the rotational angle of the rotating body in which the necessary motor torque becomes larger than the predetermined motor torque reference value, wherein the predetermined motor torque reference value is an average value over one cycle of the fluctuating necessary torque, or an average value of the necessary motor torque over a predetermined time, or a fixed value that is larger than a minimum value of the necessary motor torque and smaller than a maximum value of the necessary motor torque.

4. The control apparatus according to claim 1, wherein the speed adjusting apparatus increases or decreases the rotational instruction speed of the motor from the fixed instruction speed by a magnitude of a value that is obtained by multiplying a fixed gain by a difference between the necessary motor torque and the motor torque reference value.

5. The control apparatus according to claim 3, wherein a time integral value over a predetermine time is equal between a first amount by which the speed adjusting apparatus increases the rotational instruction speed of the motor, and a second amount by which the speed adjusting apparatus decreases the rotational instruction speed of the motor.

6. A press machine comprising:

(a) a motor;

(b) a converting mechanism having a rotating body rotationally driven by the motor and converting a rotational motion into a reciprocating motion;

(c) a slide coupled to the converting mechanism and reciprocating a motor performance torque that is fluctuated in accordance with a rotational angle of the rotating body when rotating the motor at a fixed instruction speed; and (d) a control apparatus comprising i. an angle detecting apparatus disposed to detect a rotational angle of the rotating body;

ii. a torque determining apparatus disposed to determine a necessary motor torque in correspondence to a characteristic of the press machine on a basis of a value of the rotational angle input from the angle detecting apparatus; and iii. a speed adjusting apparatus increasing the rotational instruction speed of the motor to a value more than the fixed instruction speed, at the rotational angle of the rotating body in which the necessary motor torque becomes smaller than a predetermined motor torque reference value, wherein the predetermined motor torque reference value is an average value over one cycle of the fluctuating necessary torque, or an average value of the necessary motor torque over a predetermined time, or a fixed value that is larger than a minimum value of the necessary motor torque and smaller than a maximum value of the necessary motor torque.

7. A control method of a press machine, wherein the press machine comprises:

(a) a motor;

(b) a converting mechanism having a rotating body rotationally driven by the motor and converting a rotational motion into a reciprocating motion; and (c) a slide coupled to the converting mechanism and reciprocating a motor performance torque that is fluctuated in accordance with a rotational angle of the rotating body when rotating the motor at a fixed instruction speed, wherein the control method comprises the steps of i. detecting a rotational angle of the rotating body;

ii. determining a necessary motor torque in correspondence to a characteristic of the press machine on the basis of a value of the detected rotational angle; and iii. increasing the rotational instruction speed of the motor to a value more than the fixed instruction speed, at the rotational angle of the rotating body in which the necessary motor torque becomes smaller than a predetermined motor torque reference value, wherein the necessary motor torque is determined on the basis of a motor torque fluctuation factor on the basis of the reciprocation of the slide, and a motor torque fluctuation factor on the basis of the rotational motion of the rotating body, wherein the predetermined motor torque reference value is an average value over one cycle of the fluctuating necessary torque, or an average value of the necessary motor torque over a predetermined time, or a fixed value that is larger than a minimum value of the necessary motor torque and smaller than a maximum value of the necessary motor torque.

8. A control method of a press machine, wherein the press machine comprises:

(a) a motor;

(b) a converting mechanism having a rotating body rotationally driven by the motor and converting a rotational motion into a reciprocating motion; and (c) a slide coupled to the converting mechanism and reciprocating a motor performance torque that is fluctuated in accordance with a rotational angle of the rotating body when rotating the motor at a fixed instruction speed, wherein the control method comprises the steps of i. forming a relation between a necessary motor torque value in correspondence to a characteristic of the press machine and a value of a rotational angle of the rotating body, wherein the necessary motor torque value is determined on the basis of a current supplied to the motor by executing a trial operation of the press machine;

ii. detecting a rotational angle of the rotating body;

iii. determining a necessary motor torque in correspondence to a value of the detected rotational angle on the basis of the value of the detected rotational angle and the relation; and iv. increasing a rotational instruction speed of the motor to a value more than the fixed instruction speed, at the rotational angle of the rotating body in which the necessary motor torque becomes smaller than a predetermined motor torque reference value, wherein the predetermined motor torque reference value is an average value over one cycle of the fluctuating necessary torque, or an average value of the necessary motor torque over a predetermined time, or a fixed value that is larger than a minimum value of the necessary motor torque and smaller than a maximum value of the necessary motor torque.

9. The control apparatus according to claim 2, wherein the speed adjusting apparatus increases or decreases the rotational instruction speed of the motor from the fixed instruction speed by a magnitude of a value that is obtained by multiplying a fixed gain by a difference between the necessary motor torque and the motor torque reference value.

10. The control apparatus according to claim 3, wherein the speed adjusting apparatus increases or decreases the rotational instruction speed of the motor from the fixed instruction speed by a magnitude of a value that is obtained by multiplying a fixed gain by a difference between the necessary motor torque and the motor torque reference value.

11. A press machine comprising (a) a motor;

(b) a converting mechanism having a rotating body rotationally driven by the motor and converting a rotational motion into a reciprocating motion;

(c) a slide coupled to the converting mechanism and reciprocating a motor performance torque that is fluctuated in accordance with a rotational angle of the rotating body when rotating the motor at a fixed instruction speed; and (d) a control apparatus comprising i. an angle detecting apparatus disposed to detect a rotational angle of the rotating body;

ii. a torque determining apparatus disposed to determine a necessary motor torque in correspondence to a characteristic of the press machine on a basis of a value of the rotational angle input from the angle detecting apparatus; and iii. a speed adjusting apparatus decreasing the rotational instruction seed of the motor to a value less than the fixed instruction speed, at the rotational angle of the rotating body in which the necessary motor torque becomes larger than a predetermined motor torque reference value, wherein the predetermined motor torque reference value is an average value over one cycle of the fluctuating necessary torque, or an average value of the necessary motor torque over a predetermined time, or a fixed value that is larger than a minimum value of the necessary motor torque and smaller than a maximum value of the necessary motor torque.

12. A press machine comprising:

(a) a motor;

(b) a converting mechanism having a rotating body rotationally driven by the motor and converting a rotational motion into a reciprocating motion; and (c) a slide coupled to the converting mechanism and reciprocating, a motor performance torque that is fluctuated in accordance with a rotational angle of the rotating body when rotating the motor at a fixed instruction speed; and, (d) wherein the control apparatus comprises:

i. an angle detecting apparatus disposed to detect a rotational angle of the rotating body;

ii. a torque determining apparatus disposed to determine a necessary motor torque in correspondence to a characteristic of the press machine on a basis of a value of the rotational angle input from the angle detecting apparatus; and iii. a speed adjusting apparatus increasing the rotational instruction speed of the motor to a value more than the fixed instruction speed, at the rotational angle of the rotating body in which the necessary motor torque becomes smaller than a predetermined motor torque reference value, and decreasing the rotational instruction speed of the motor to a value less than the fixed instruction speed, at the rotational angle of the rotating body in which the necessary motor torque becomes larger than the predetermined motor torque reference value, wherein the predetermined motor torque reference value is an average value over one cycle of the fluctuating necessary torque, or an average value of the necessary motor torque over a predetermined time, or a fixed value that is larger than a minimum value of the necessary motor torque and smaller than a maximum value of the necessary motor torque.

13. A press machine comprising:

(a) a motor;

(b) a converting mechanism having a rotating body rotationally driven by the motor and converting a rotational motion into a reciprocating motion;

(c) a slide coupled to the converting mechanism and reciprocating a motor performance torque that is fluctuated in accordance with a rotational angle of the rotating body when rotating the motor at a fixed instruction speed; and (d) the control apparatus comprising i. an angle detecting apparatus disposed to detect a rotational angle of the rotating body;

ii. a torque determining apparatus disposed to determine a necessary motor torque in correspondence to a characteristic of the press machine on a basis of a value of the rotational angle input from the angle detecting apparatus; and iii. a speed adjusting apparatus increasing the rotational instruction speed of the motor to a value more than the fixed instruction speed, at the rotational angle of the rotating body in which the necessary motor torque becomes smaller than a predetermined motor torque reference value, wherein the predetermined motor torque reference value is an average value over one cycle of the fluctuating necessary torque, or an average value of the necessary motor torque over a predetermined time, or a fixed value that is larger than a minimum value of the necessary motor torque and smaller than a maximum value of the necessary motor torque, wherein the speed adjusting apparatus increases or decreases the rotational instruction speed of the motor from the fixed instruction speed by a magnitude of a value that is obtained by multiplying a fixed gain by a difference between the necessary motor torque and the motor torque reference value.

14. A press machine comprising:

(a) a motor;

(b) a converting mechanism having a rotating body rotationally driven by the motor and converting a rotational motion into a reciprocating motion;

(c) a slide coupled to the converting mechanism and reciprocating a motor performance torque that is fluctuated in accordance with a rotational angle of the rotating body when rotating the motor at a fixed instruction speed; and (d) the control apparatus comprises i. an angle detecting apparatus disposed to detect a rotational angle of the rotating body;

ii. a torque determining apparatus disposed to determine a necessary motor torque in correspondence to a characteristic of the press machine on the basis of a value of the rotational angle input from the angle detecting apparatus; and iii. a speed adjusting apparatus increasing the rotational instruction speed of the motor to a value more than the fixed instruction speed, at the rotational angle of the rotating body in which the necessary motor torque becomes smaller than a predetermined motor torque reference value, and decreasing the rotational instruction speed of the motor to a value less than the fixed instruction speed, at the rotational angle of the rotating body in which the necessary motor torque becomes larger than the predetermined motor torque reference value, wherein the predetermined motor torque reference value is an average value over one cycle of the fluctuating necessary torque, or an average value of the necessary motor torque over a predetermined time, or a fixed value that is larger than a minimum value of the necessary motor torque and smaller than a maximum value of the necessary motor torque, wherein a time integral value over a predetermine time is equal between a first amount by which the speed adjusting apparatus increases the rotational instruction speed of the motor, and a second amount by which the speed adjusting apparatus decreases the rotational instruction speed of the motor.

* * * * *

UNITED STATES PATENT AND TRADEMARK OFFICE

CERTIFICATE OF CORRECTION

PATENT NO. : 8,047,131 B2
APPLICATION NO. : 12/294695
DATED : November 1, 2011
INVENTOR(S) : Dai Onishi et al.

It is certified that error appears in the above-identified patent and that said Letters Patent is hereby corrected as shown below:

On the Title Page
Item (75) Inventors: "Dan Onishi" should read -- Dai Onishi --

Signed and Sealed this
Fourteenth Day of February, 2012

David J. Kappos

David J. Kappos
*Director of the United States Patent and Trademark Office*